US012025372B2

(12) United States Patent
Tranier

(10) Patent No.: US 12,025,372 B2
(45) Date of Patent: Jul. 2, 2024

(54) METHOD AND APPARATUS FOR AIR SEPARATION BY CRYOGENIC DISTILLATION

(71) Applicant: L'Air Liquide, Societe Anonyme pour l'Etude et l'Exploitation des Procedes Georges Claude, Paris (FR)

(72) Inventor: Jean-Pierre Tranier, L'Hay-les-Roses (FR)

(73) Assignee: L'Air Liquide, Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 1196 days.

(21) Appl. No.: 16/615,978

(22) PCT Filed: May 18, 2018

(86) PCT No.: PCT/FR2018/051201
§ 371 (c)(1),
(2) Date: Nov. 22, 2019

(87) PCT Pub. No.: WO2018/215716
PCT Pub. Date: Nov. 29, 2018

(65) Prior Publication Data

US 2020/0132367 A1 Apr. 30, 2020

(30) Foreign Application Priority Data

May 24, 2017 (FR) ..... 1754619
May 24, 2017 (FR) ..... 1754624

(51) Int. Cl.
*F25J 3/04* (2006.01)
*F25J 1/00* (2006.01)
*F25J 1/02* (2006.01)

(52) U.S. Cl.
CPC ..... *F25J 3/04054* (2013.01); *F25J 1/0012* (2013.01); *F25J 1/0015* (2013.01);
(Continued)

(58) Field of Classification Search
CPC ..... F25J 3/0409; F25J 2200/06; F25J 1/0012; F25J 3/04054; F25J 2245/40;
(Continued)

(56) References Cited

U.S. PATENT DOCUMENTS 5,379,598 A 1/1995 Mostello
5,475,980 A 12/1995 Grenier et al.
(Continued)

FOREIGN PATENT DOCUMENTS

DE 460 927 C 6/1928
EP 0 044 679 1/1982
(Continued)

OTHER PUBLICATIONS

International Search Report and Written Report for PCT/FR2018/051201, dated Aug. 30, 2018.

*Primary Examiner* — Schyler S Sanks
(74) *Attorney, Agent, or Firm* — Justin K. Murray

(57) ABSTRACT

A method for separating air by cryogenic distillation in a system of columns comprising a first column and a second column operating at a lower pressure than the first column, comprising the steps of compressing all of the feed air in a first compressor to a first output pressure of at least 1 bar greater than the pressure of the first column, sending a first portion of the air under the first output pressure to the second compressor, and compressing the air to a second output pressure, cooling and condensing at least a portion of the air under the second output pressure in a heat exchanger, withdrawal of a liquid from a column of the system of columns, pressurising the liquid and evaporating the liquid
(Continued)

by heat exchange in the heat exchanger, and pressure reduction of a portion of the compressed air to a second output pressure, at least partially evaporating said air in the heat exchanger, optionally additional heating of said air in the heat exchanger, and sending at least a portion of this air to the second compressor.

17 Claims, 6 Drawing Sheets

(52) U.S. Cl.
CPC ..... *F25J 1/0037* (2013.01); *F25J 1/0224* (2013.01); *F25J 1/0234* (2013.01); *F25J 3/04084* (2013.01); *F25J 3/0409* (2013.01); *F25J 3/04181* (2013.01); *F25J 3/04278* (2013.01); *F25J 3/04303* (2013.01); *F25J 3/04339* (2013.01); *F25J 3/04351* (2013.01); *F25J 3/04387* (2013.01); *F25J 3/04509* (2013.01); *F25J 3/04678* (2013.01); *F25J 2200/06* (2013.01); *F25J 2205/66* (2013.01); *F25J 2210/42* (2013.01); *F25J 2210/50* (2013.01); *F25J 2240/10* (2013.01); *F25J 2250/42* (2013.01); *F25J 2250/58* (2013.01); *F25J 2270/90* (2013.01)

(58) Field of Classification Search
CPC .. F25J 2240/10; F25J 2230/40; F25J 2210/06; F25J 3/04187; F25J 3/04866
See application file for complete search history.

(56) References Cited

U.S. PATENT DOCUMENTS

| | | | | |
|---|---|---|---|---|
| 5,596,885 | A | 1/1997 | Grenier | |
| 5,901,576 | A | 5/1999 | Agrawal et al. | |
| 5,966,967 | A * | 10/1999 | Agrawal | F25J 3/04393 62/646 |
| 6,257,020 | B1 * | 7/2001 | Tranier | F25J 3/04278 62/646 |
| 6,336,345 | B1 | 1/2002 | Corduan | |
| 6,626,008 | B1 | 9/2003 | Prosser et al. | |
| 2009/0120129 | A1 * | 5/2009 | Howard | F25J 3/044 62/651 |

FOREIGN PATENT DOCUMENTS

| | | |
|---|---|---|
| EP | 0 752 566 | 1/1997 |
| EP | 1 972 872 | 9/2008 |
| EP | 2 299 221 | 3/2011 |
| EP | 2 600 090 | 6/2013 |
| FR | 2 777 641 | 10/1999 |

* cited by examiner

METHOD AND APPARATUS FOR AIR SEPARATION BY CRYOGENIC DISTILLATION

CROSS REFERENCE TO RELATED APPLICATIONS

This application is a § 371 of International PCT Application PCT/FR2018/051201, filed May 18, 2018, which claims the benefit of FR1754619 and FR1754624, both filed May 24, 2017, all of which are herein incorporated by reference in their entireties.

TECHNICAL FIELD OF THE INVENTION

The present invention relates to a process and to an apparatus for the separation of air by cryogenic distillation. It relates in particular to processes and an apparatus for producing oxygen and/or nitrogen under an elevated pressure.

BACKGROUND OF THE INVENTION

The oxygen gas produced by air separation units is usually at a high pressure of approximately 20 to 50 bar. The basic distillation scheme is usually a double-column process producing oxygen at the bottom of the second column, carried out under a pressure of 1 to 4 bar. The oxygen has to be compressed to a higher pressure, by virtue of an oxygen compressor or by virtue of the liquid pumping process. As a result of the safety problems associated with oxygen compressors, the most recent oxygen production units use the liquid pumping process. In order to vaporize the liquid oxygen under an elevated pressure, an additional booster is needed in order to raise a part of the feed nitrogen or air to a higher pressure, within the range from 40 to 80 bar. Essentially, the booster replaces the oxygen compressor. One of the aims of the development of new process cycles is to reduce the energy consumption of an oxygen production unit.

In an effort to reduce this energy consumption, it is desirable to introduce all the feed air flows into the columns at a temperature close to the temperature of the column, at the point where the flow is introduced, in order to reduce the thermodynamic irreversibility of the system. Unfortunately, this cannot be achieved with a "conventional" pumping cycle.

This prior art is illustrated in FIG. 1. In FIG. 1, as described in FR-A-2 777 641, use is made, in an air separation unit 1, of a double column 2, comprising a first column 8 and a second column 9 operating at a lower pressure than the first column, which columns are thermally connected by a reboiler/condenser 10. All of the feed air is compressed in a compressor 6 to the pressure of the first column 8, purified in the purification unit 7 and subdivided into three.

A flow 502 is sent to a booster 503, cooled in a water cooler (not represented), and cooled even more in the heat exchanger 5, then reduced in pressure in a turbine 501 coupled to the booster 503. The pressure-reduced air 502 is sent to the second column.

Another part of the air is sent to the heat exchanger 5 substantially under the same pressure as the first column 8.

The third flow is compressed in a compressor 230 and sent into the heat exchanger, where it condenses. The liquefied air is subdivided between the first column 8 and the second column 9.

A flow of liquid enriched in oxygen LR is reduced in pressure and sent from the first column to the second column. The flow of liquid enriched in nitrogen LP is reduced in pressure and sent from the first column to the second column. Pure liquid nitrogen NLMP is produced by the first column, then again cooled in the heat exchanger 24, reduced in pressure in the valve 143 and sent to a storage tank 144. The high-pressure nitrogen gas 39 is withdrawn at the top of the first column and heated in the heat exchanger to form a product flow 40. The liquid oxygen OL is withdrawn from the bottom of the second column 9, pressurized by a pump 37 and sent in part in the form of a flow 38 to the heat exchanger 5, where it vaporizes by exchange of heat with the pressurized air to form a pressurized oxygen gas. The remainder of the liquid oxygen 52 is withdrawn in the form of a liquid product. A top gas flow enriched in nitrogen NR is withdrawn from the second column 9 and heated in the heat exchanger 5 in the form of a flow 33.

Argon is produced by use of an impure argon column 3 and a pure argon column 4. The impure argon column is fed with a flow 16 originating from the second column 9. A liquid flow 17 is sent from the bottom of the impure argon column 3 to the second column 9. A rich layer is sent to the top condenser 12 of the column 3 via the valve 26 and is evaporated to form a flow 27 which is sent back to the second column. A product flow 19 is sent to the condenser 20 and from there forms the flow 19. The flow 19 is condensed in the heat exchanger 20 and subdivided into the flow 48, which is sent to the waste flow 33 at the point of intersection 50, and another flow. The other flow is sent via the valve 21 to the column 4.

The pure argon column 4 produces a product flow 45. The top condenser 13 of the pure argon column 4 is fed with the liquid rich in nitrogen LP originating from the first column via the valve 34, and the vaporized nitrogen is withdrawn via the valve 35 in the form of a flow 33 and cooled in the subcooler 24.

The bottom reboiler 14 of the pure argon column is heated by use of air, and the liquefied air 23 is sent to the first column.

A purge flow 46 is also withdrawn from it.

The condenser 20 is fed with the liquid rich in nitrogen LP via the valve 31, and the vaporized liquid is sent via the valve 32 to the waste flow 33.

FIG. 2 shows the relationships between the heat exchange in kcal/h and the temperature for the fluids cooling and reheating in the exchanger 5.

Some different versions of the cold compression process are also described in the prior art, as in U.S. Pat. Nos. 5,379,598, 5,475,980, 5,596,885, 5,901,576 and 6,626,008.

In U.S. Pat. No. 5,379,598, a fraction of the feed air is recompressed by a booster, followed by a cold compressor, to give a pressurized flow necessary for the vaporization of the oxygen. This approach still possesses at least two compressors, and the purification unit still operates under a low pressure.

A cold compression process, such as described in U.S. Pat. No. 5,475,980, provides a technique for controlling an oxygen production unit with a single air compressor. In this process, air to be distilled is cooled in the heat exchanger, is then again compressed by a booster controlled by a pressure-reduction device, the effluent of which is sent into the first column of a double-column process, that which operates at the highest pressure.

Doing this, the delivery pressure of the air compressor is of the order of 15 bar, which is likewise very advantageous for the purification unit. One disadvantage of this approach lies in the increase in the size of the heat exchanger due to the additional recycling of the flow, which is representative of a cold compression unit. It is possible to reduce the size of the heat exchanger by opening the temperature approaches of the exchanger. However, this would result in an inefficient use of the energy and in a higher delivery pressure of the compressor, which would increase the cost.

In U.S. Pat. No. 5,596,885, a part of the feed air is subjected to a more forceful compression in a hot booster, during which at least a part of the air is further compressed in a cold booster. The air originating from the two boosters is liquefied, and a part of the cold compressed air is reduced in pressure in a Claude turbine.

U.S. Pat. No. 5,901,576 describes different arrangements of cold compression schemes using the reduction in pressure of a vaporized rich liquid from the bottom of the first column or the reduction in pressure of the high-pressure nitrogen in order to drive the cold compressor. In some cases, cold compressors driven by a motor were also used. These processes also operate with feed air approximately at the pressure of the first column and, in the majority of cases, a booster is also needed.

U.S. Pat. No. 6,626,008 describes a heat pump cycle using a cold compressor to improve the distillation process for the production of oxygen of low purity for a double-vaporizer oxygen production process. A low air pressure, and a booster, are also representative of this type of process.

EP-A-1 972 872 describes means for improving the above processes, resorting to a cold compressor, in particular by introduction of all of the feed air flows into the columns at a temperature close to the temperature of the column at the point where the flow is introduced, with the aim of reducing the thermodynamic irreversibility of the system. However, it requires the addition of at least one additional compression stage.

SUMMARY OF THE INVENTION

The present invention is thus targeted at overcoming the disadvantages of these processes, in particular by introduction of all of the feed air flows into the columns at a temperature close to the temperature of the column at the point where the flow is introduced, with the aim of reducing the thermodynamic irreversibility of the system, without addition of an additional compression stage. The overall cost of the products of an oxygen production unit can thus be reduced. The main improvement is due to the use of a booster air compressor (BAC) in order to recycle the air once it has been used in order to recover the heat produced by the vaporization of a high-pressure liquid in the main heat exchanger.

All the percentages mentioned are percentages in moles.

According to the present invention, provision is made for a process for separating air by cryogenic distillation in a system of columns comprising a first column and a second column operating at a lower pressure than the first column, comprising the steps of:

i) compression of all of the feed air in a first compressor up to a first outlet pressure of at most one bar greater than the pressure of the first column, preferably substantially equal to the pressure of the first column, ii) sending a first part of the air under the first outlet pressure to a second compressor, and compression of the air to a second outlet pressure, iii) cooling and condensation of at least a part of the air under the second outlet pressure in a heat exchanger, iv) withdrawal of the liquid from a column of the system of columns, pressurization of the liquid and vaporization of the liquid by heat exchange in the heat exchanger, v) reduction in pressure of at least a fraction of the air cooled and condensed under the second outlet pressure down to an intermediate pressure between the first outlet pressure and the second outlet pressure, at least partial vaporization of said air in the heat exchanger, optionally heating of said air in the heat exchanger, characterized in that at least a part of this air is sent to the second compressor in order to be compressed up to the second outlet pressure.

Purified and cooled air is sent from the first compressor to the system of columns in order to be separated therein.

According to other optional aspects of the invention, which can be combined with one another:

the reduction in pressure is carried out in at least one valve, the reduction in pressure is carried out in at least one turbine and produces work, the temperature of the at least a fraction before reduction in pressure is less than the sum of the temperature of the vaporization of the liquid and the minimum temperature approach in the heat exchanger, the second compressor is a multistage compressor, said at least a third pressure is at least the inlet pressure of one of the stages of the second compressor, a stage of the second compressor is driven by a device for the reduction in pressure of a fluid of the process, the inlet temperature of the device for the reduction in pressure is less than ambient temperature, at least one stage of the second compressor has a suction temperature which is less than ambient temperature, the suction temperature is greater than the vaporization temperature of the liquid, but is close to it, the liquid is a flow enriched in oxygen, the liquid is a flow enriched in nitrogen, the production flow of the liquid product or products is not greater than 10% of the feed air, preferably is not greater than 5% of the feed air.

According to another aspect of the invention, provision is made for an apparatus for separating air by cryogenic distillation in a system of columns comprising a first column and a second column operating at a lower pressure than the first column, additionally comprising:

i) a first compressor for compressing the feed air up to a first outlet pressure of at least one bar greater than the pressure of the first column, preferably substantially equal to the pressure of the first column, ii) a second compressor and a means for sending a first part of the air under the first outlet pressure to the second compressor, in order to compress the air up to a second outlet pressure, iii) a heat exchanger, in which at least a part of the air under the second outlet pressure is cooled and condensed, iv) a means for withdrawing the liquid from a column of the system of columns, a means for pressurizing the liquid, a means for sending the pressurized liquid to the heat exchanger and a means for withdrawing the vaporized liquid from the heat exchanger, v) a means for reducing in pressure a fraction of the air cooled and condensed under the second outlet pressure, a means for sending said air fluid to the heat exchanger, a means for sending at least a part of said air which has been vaporized in the heat exchanger under at least a third pressure, intermediate between the first and second outlet pressures, to the second compressor in order to be compressed up to the second outlet pressure, and vi) means for sending purified and cooled air to the system of columns in order to be separated therein.

According to other optional aspects of the invention:

the first storage tank and optionally the second storage tank is independent of the system of columns, the apparatus comprises a turbine for reduction in pressure of the fraction of auxiliary flow compressed in the second compressor.

BRIEF DESCRIPTION OF THE DRAWINGS

The present invention will be clearly understood and its advantages will arise from the description which follows, given merely as a non-limitative example, and with reference to the attached drawings in which.

DETAILED DESCRIPTION

The invention will now be described in more detail with reference to FIGS. 3, 5 and 6, which are schemes of circulation of the fluids representing processes for the cryogenic separation of air according to the invention, and FIG. 4, which is a heat exchange diagram for the exchanger 5 of FIG. 3.

Figure 1:
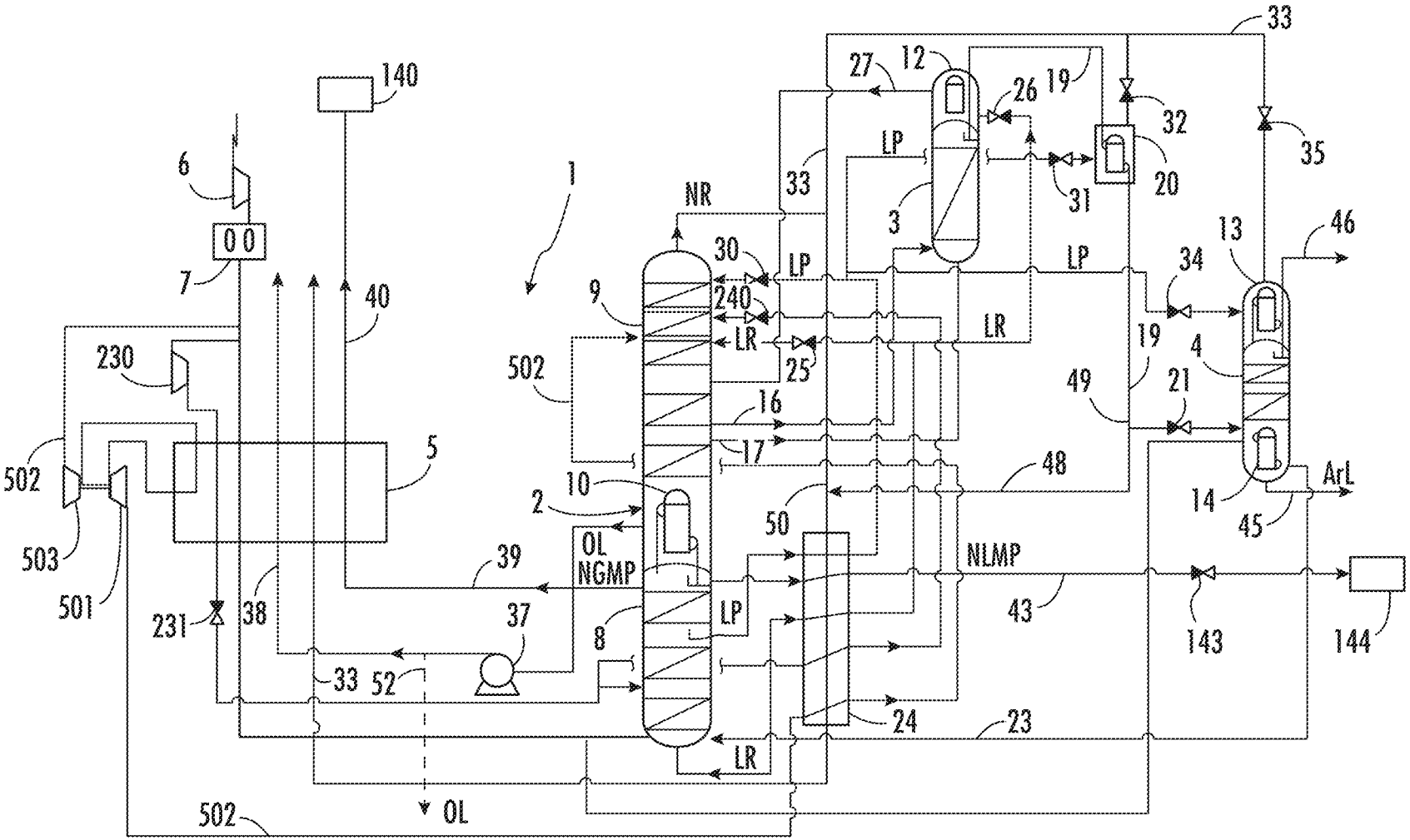
FIG. 1 provides an embodiment of the prior art.
Figure 2:
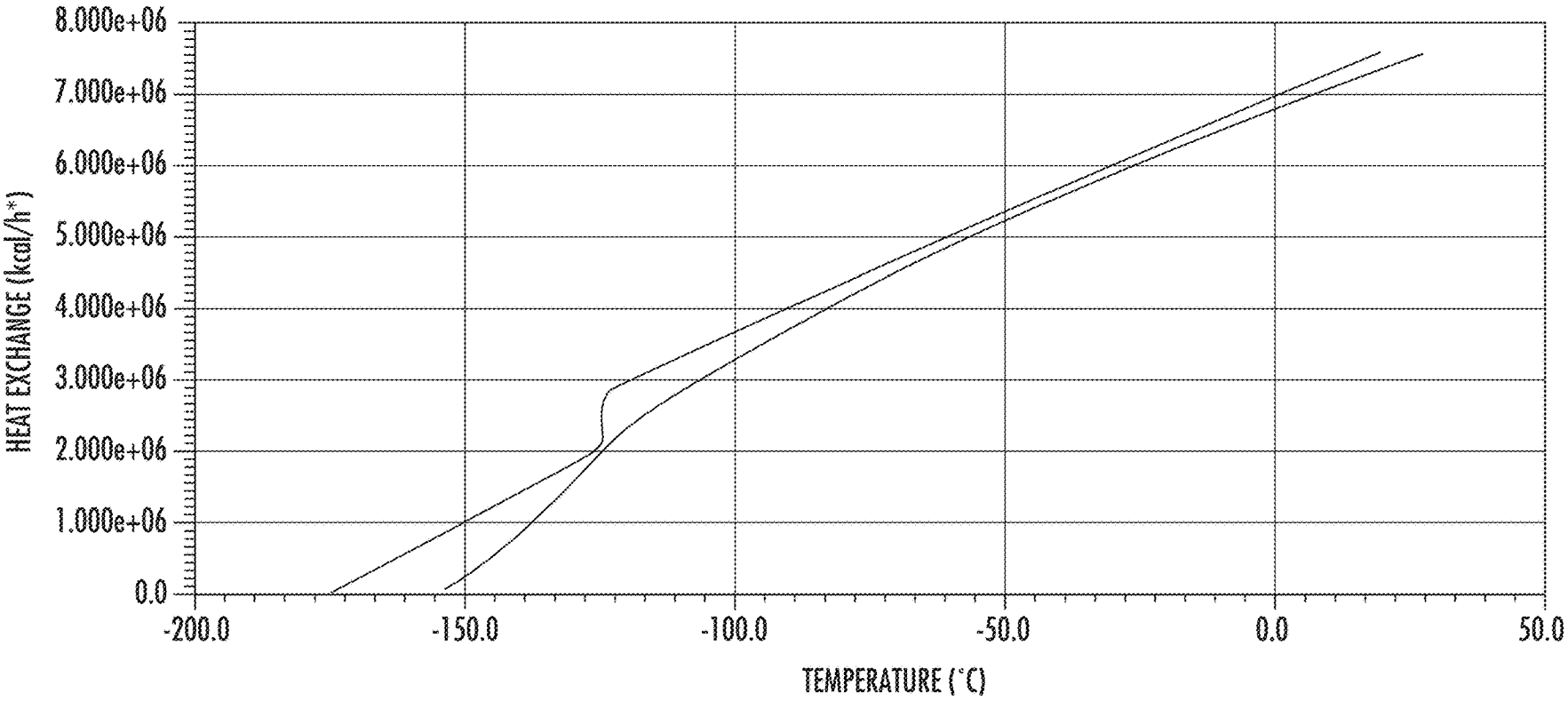
FIG. 2 shows the relationships between the heat exchange in kcal/h and the temperature for the fluids cooling and reheating in the embodiment of FIG. 1.
Figure 3:
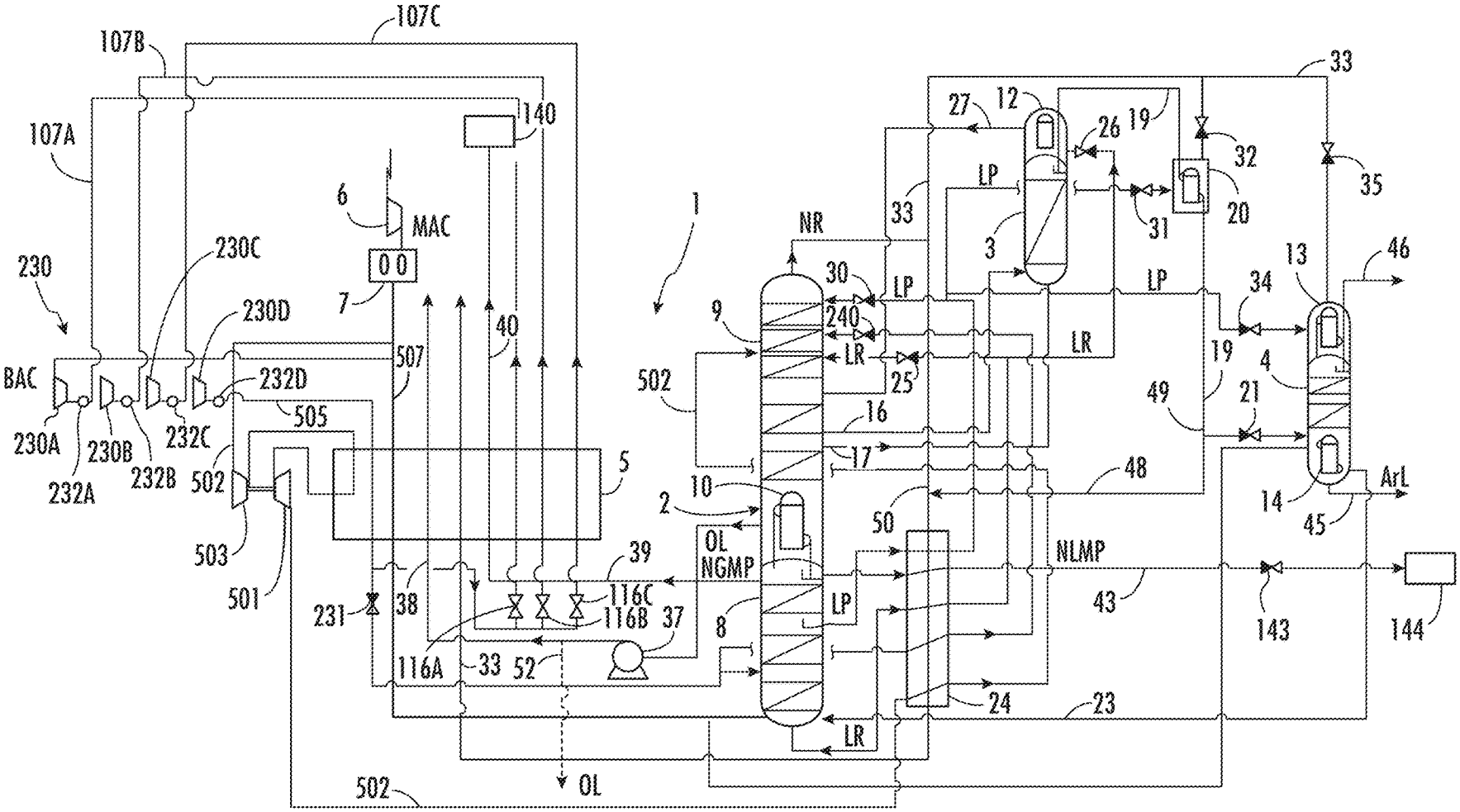
FIG. 3 provides a process flow diagram in accordance with an embodiment of the present invention.

In the embodiment of FIG. 3, in an air separation unit 1, use is made of a double column 2, comprising a first column 8 and a second column 9 made available, which are thermally connected by a reboiler/condenser 10. All of the feed air is compressed in the compressor 6 to a pressure of at least one bar greater than the pressure of the first column 8, preferably substantially equal to the pressure of the first column 8, making possible a fall in pressure in the intermediate pipes, which feed air is purified in the purification unit 7 and subdivided into three.

A flow 502 is sent to a booster 503, cooled in a water cooler (not represented), then again cooled in the heat exchanger 5, then reduced in pressure in a turbine 501 coupled to the booster 503. The pressure-reduced air 502 is sent to the second column.

Another part 507 of the air is sent to the heat exchanger 5 under a pressure substantially equal to that of the first column 8.

The third flow 505 is compressed in a compressor 230 and sent to the heat exchanger, where it condenses. In this case, it is considered that the compressor 230 is a centrifugal compressor comprising four stages 230A, 230B, 230C and 230D, for example of the integrally geared type cooled by water intercoolers 232A, 232B, 232C and an aftercooler 232D. The suction pressure of the compressor is 5.5 bar abs, the intermediate pressures are 10.2 bar abs, 18.9 bar abs and 35.1 bar abs, and the final outlet pressure is 65 bar abs. The suction flow is 26.5% of the total flow of the air. The liquefied air is subdivided between the first column 8, the second column 9 and the fractions to be reduced in pressure in the valves 116A, 116B and 116C.

A flow of liquid enriched in oxygen LR is reduced in pressure and sent from the first column to the second column. A flow of liquid enriched in nitrogen LP is reduced in pressure and sent from the first column to the second column.

Pure liquid nitrogen NLMP is produced by the first column 8, again cooled in the heat exchanger 24, reduced in pressure in the valve 143 and sent to the storage tank 144. The high-pressure nitrogen gas 39 is withdrawn at the top of the first column and heated in the heat exchanger to form a product flow 40. The liquid oxygen OL is withdrawn from the bottom of the second column 9, pressurized by a pump 37 and sent in part in the form of a flow 38 to the heat exchanger 5, where it vaporizes by exchange of heat with the pressurized air to form pressurized oxygen gas. The remainder of the liquid oxygen 52 is withdrawn in the form of a liquid product. A top gas flow NR, enriched in nitrogen, is withdrawn from the second column 9 and heated in the heat exchanger 5 in the form of a flow 33.

Argon is produced by use of the impure argon column 3 and the pure argon column 4. The impure argon column is fed with the flow 16 originating from the second column 9. A liquid flow 17 is sent from the bottom of the impure argon column 3 to the second column 9. The liquid enriched in oxygen is sent to the top condenser 12 of the column 3 via the valve 26 and is evaporated to form the flow 27 which is sent back to the second column. A product flow 19 is sent to the condenser 20 and, from there, forms the flow 19. The flow 19 is condensed in the heat exchanger 20 and subdivided into a flow 48, which is sent to the waste flow 33 at the point of intersection 50, and another flow. The other flow is sent via the valve 21 to the column 4.

The pure argon column 4 produces a product flow 45. The top condenser 13 of the pure argon column 4 is fed with the liquid LP rich in nitrogen originating from the first column via the valve 34, and the vaporized nitrogen is withdrawn via the valve 35 in the form of a flow 33 and cooled in the subcooler 24. The bottom reboiler 14 of the pure argon column is heated by use of air, and the liquefied air 23 is sent to the first column.

A purge flow 46 is likewise withdrawn.

The liquid 43 rich in nitrogen is collected via the valve 143 in the storage tank 144.

The condenser 20 is fed with the liquid LP rich in nitrogen via the valve 31, and the vaporized liquid is sent via the valve 32 to the waste flow 33.

After cooling and condensing in the heat exchanger 5 toward the cold end of the heat exchanger, the air flow 505 under 65 bar is subdivided into two. A part of the air is reduced in pressure in the valve 231 and sent to the columns 8 and 9 in liquid form.

The remainder of the air 107 is subdivided in three fractions 107A, 107B and 107C. The air fraction 107A recycled between the first stage 230A and the second stage 230B corresponds to 1.08% of the total air flow. It is reduced in pressure in the valve 116A from 65 bar abs to approximately 10.2 bar abs and introduced in the heat exchanger 5, where it is vaporized, heated after vaporization to give a recycling air 107A.

The air fraction 107B recycled between the second stage 230B and the third stage 230C corresponds to 0.84% of the total air flow. It is reduced in pressure in the valve 116B from 65 bar abs to approximately 18.9 bar abs and introduced in the heat exchanger 5, where it is vaporized, heated after vaporization to give a recycling air 107B.

The air fraction 107C recycled between the third stage 230C and the fourth stage 230D corresponds to 22.08% of the total air flow. It is reduced in pressure in the valve 116C from 65 bar abs to approximately 35.1 bar abs and introduced in the heat exchanger 5, where it is vaporized, heated after vaporization to give a recycling air 107C.

These three air fractions represent a total recycling air flow of 24% of the total air flow, which means that the fluid 505 corresponds to a flow of 50.5% of the total airflow and that the flow via the valve 231 is 26.5%. The vaporization of the three air fractions 107A, 107B and 107C takes place in the heat exchanger 5 respectively at temperatures of approximately −166° C., −155° C. and −142° C., as may be seen in FIG. 4, which is lower than the vaporization temperature of oxygen, which is approximately −125° C. A phase separator has to be added if the pressure-reduced flow is a two-phase fluid, the liquid phase being introduced into the heat exchanger 5 and the vapor phase being mixed with the flow 107. The term "condensation" covers the condensation of a vapor form to a liquid or partially liquid form. It also covers the pseudo-condensation of a supercritical fluid when it is cooled from a temperature greater than the supercritical temperature to a temperature lower than the supercritical temperature.

Figure 4:
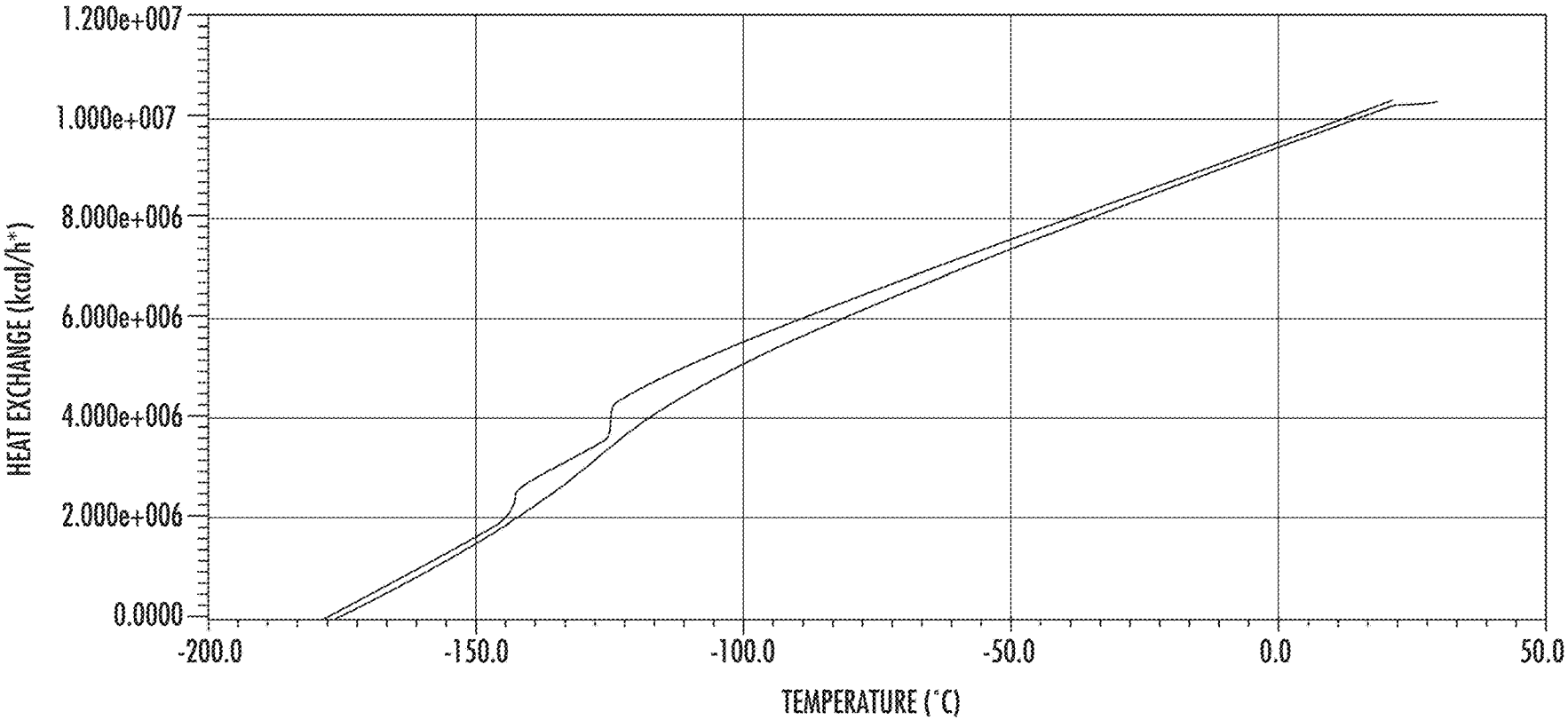
FIG. 4 shows the relationships between the heat exchange in kcal/h and the temperature for the fluids cooling and reheating in the embodiment of FIG. 3.

FIG. 4 presents the exchange diagram corresponding to the process of FIG. 3.

A less optimized alternative form of FIG. 3 should imply the subdivision of the flow 107 into one or two fractions and the recycling of these fractions, after vaporization, with return to the compressor 230.

In order to simplify the process described above, in view of the low flows of 107A and of 107B, it is possible to retain a single recycled air fraction 107C.

The valves 231, 116A, 116B and 116C might be replaced with liquid turbines, that is to say a pressure-reducing system which produces work, with the aim of decreasing the irreversibility associated with the isenthalpic reduction in pressure. These liquid turbines might be installed in parallel or in series.

The compressor 230, in the basic case, is regarded as being a machine driven by a motor, but might also be driven by a vapor turbine or a gas turbine (the same as that for the Main Air Compressor 6). As an alternative, any one of the four compressor stages 230A, 230B, 230C and 230D might be driven by a machine for reducing in pressure any one of the fluids of this air cryogenic separation process, preferably at low temperature. In addition, any one of the four compressor stages 230A, 230B, 230C and 230D might have a suction temperature which is lower than ambient temperature, preferably slightly greater than the vaporization temperature of oxygen, at approximately −125° C. In terms of specific energy (kWh/Nm$^3$ of $O_2$), if the prior technique corresponds to 100, the specific energy necessary for the production of oxygen under 40 bar abs according to the invention is 92.9, that is to say a saving of 7.1%.

The fractions 107A, 107B and 107C might be separated from the part of the air passing through 231 and be extracted from the heat exchanger 5 at a temperature greater than the temperature of the cold end of the heat exchanger 5.

The process can be modified in order to vaporize the pumped liquid nitrogen, as additional flow or as flow replacing the pumped oxygen flow.

It is likewise possible to use a nitrogen cycle (rather than an air cycle) in an alternative form which is not covered by the claims. In this case, the compressor 230 should be fed with at least a part of the high-pressure nitrogen gas 40.

It is likewise possible to use the invention to reduce the design pressure of the heat exchanger 5, that is to say the second air pressure, with a lower energy penalty by virtue of the recycling of the flow 107.

The processes illustrated exhibit double-column systems but it will be easily understood that the invention applies to triple-column systems.

They might also be used with process cycles producing oxygen of low purity (usually 95% $O_2$ instead of 99.5% $O_2$), such as the "double-vaporizer" process cycles.

Figure 5:
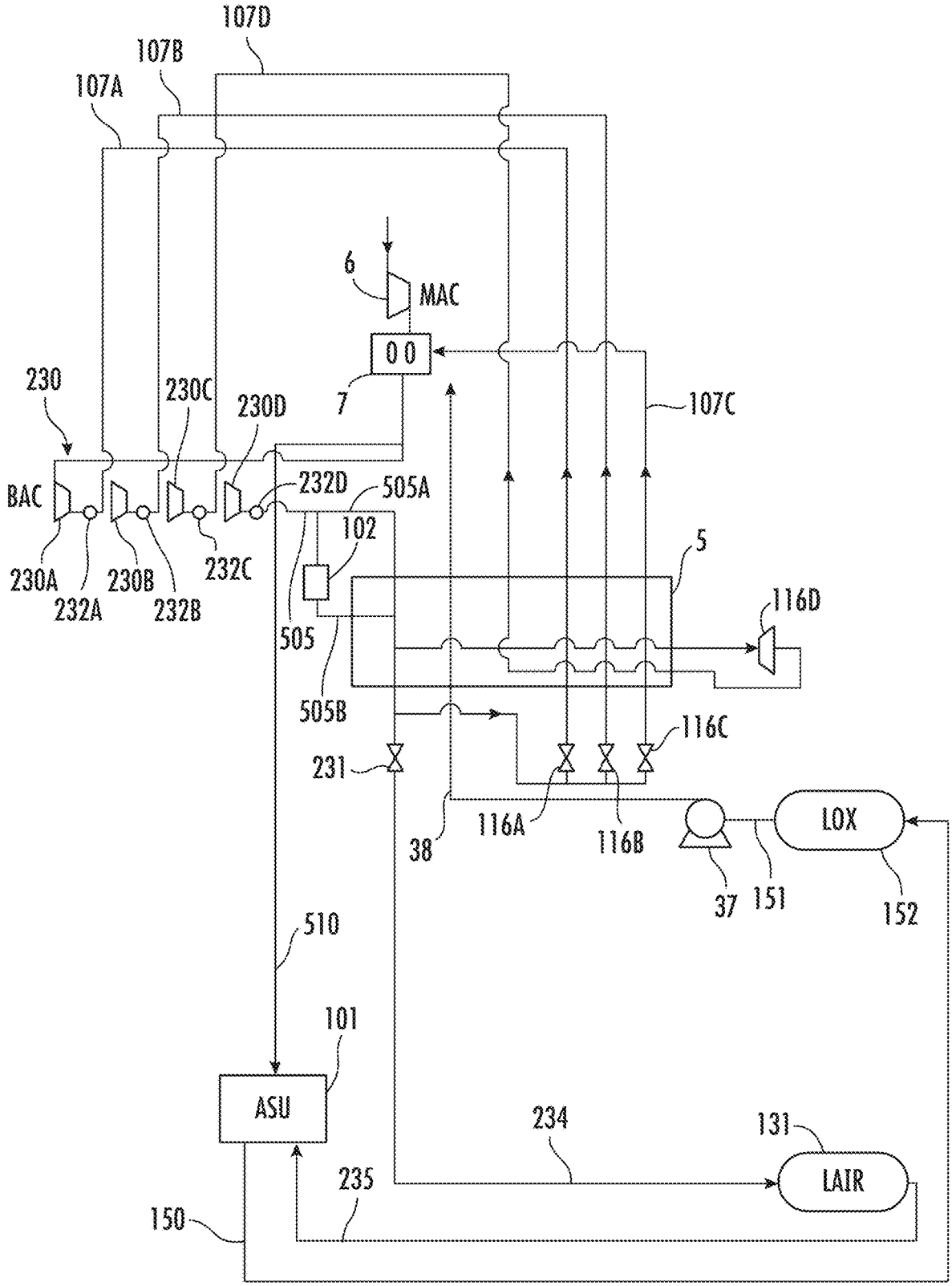
FIG. 5 provides a process flow diagram in accordance with another embodiment of the present invention.

In the embodiment of FIG. 5, provision is made to make use of the system of FIG. 3 to recover cold from the liquid oxygen in a more independent manner starting from the air separation unit 101.

In particular, liquid holding tanks 131, 152 are added to the storage unit and release cryogenic liquids in order to disconnect the production of oxygen by the ASU from the consumption by the client. In addition, they make it possible to reduce the energy consumption at the peak periods without reducing the oxygen flow going to the final user, and make possible the increase in the consumption of hydrogen at the off-peak periods, without increasing the oxygen flow toward the final user.

The feed air is compressed in the compressor 6, purified in the purification unit 7 and subdivided into two.

A flow 505 is compressed in a compressor 230 and is sent to the heat exchanger, where it undergoes a partial condensation, or "pseudo-condensation", as it is above the critical pressure. In this case, it is considered that the compressor 230 is a centrifugal compressor comprising four stages 230A, 230B, 230C and 230D, for example of the integrally geared type cooled by water intercoolers 232A, 232B, 232C and an aftercooler 232D. The suction pressure of the compressor is 5.5 bar abs, the intermediate pressures are 10.2 bar abs, 18.9 bar abs and 35.1 bar abs, and the final pressure 65 bar abs. The suction flow is 23% of the total air flow when no cryogenic liquid is stored or taken from store.

The flow 505 is divided into a first secondary flow 505A, which goes directly to the heat exchanger 5, and a second secondary flow, which goes to the refrigeration unit 102 in order to be cooled to −5° C. and introduced into the heat exchanger 5.

At an intermediate point of the heat exchanger 5, at a temperature of −124° C., a first fraction of the high-pressure air is withdrawn and sent to the two-phase device for the reduction in pressure 116D, reintroduced into the heat exchanger 5 in order to be heated and recycled at 35.1 bar abs in the compressor 230 at the stage 230D as flow 107D. This first fraction has a flow of 18.4% of the total air flow.

A second fraction is cooled to −192.2° C. by passing completely through the heat exchanger 5 and is reduced in pressure in the valve 231 in order to be sent to the storage unit 131 for liquid air (LAIR) as flow 234. The flow of this second fraction is only 23% of the total air flow originating from the main air compressor 6.

A fraction 107 is withdrawn from the cold end of the heat exchanger 5 and subdivided into three. The air fraction 107A recycled between the first stage 230A and the second stage 230B corresponds to 1.1% of the total air flow. It is reduced in pressure in the valve 116A from 65 bar abs to approximately 10.2 bar abs and introduced in the heat exchanger 5, where it is evaporated, heated after vaporization to give a recycling air 107A.

The air fraction 107B recycled between the second stage 230B and the third stage 230C corresponds to 3.15% of the total air flow. It is reduced in pressure in the valve 116B from 65 bar abs to approximately 18.9 bar abs and is introduced in the heat exchanger 5, where it is vaporized, heated after vaporization to give a recycling air 107B.

The air fraction 107C is reduced in pressure in the valve 116C from 65 bar abs to approximately 1.2 bar abs and is introduced into the heat exchanger 5, where it is vaporized, heated after vaporization to give a recycling air 107C which can be used to regenerate air purifiers if the ASU 101 is not in operation. It represents 4.45% of the total air flow. These three air fractions 107A, 107B and 107C, and the first air fraction reduced in pressure in the turbine 116D, represent a total recycling air flow of 27.1% of the total air flow originating from the compressor 230, which means that the fluid 505 represents 50.1% of the total air flow originating from the main compressor 6, and the flow passing through the valve 231 corresponds to 23% of the total air flow.

A storage tank for liquid oxygen 152 fed by the ASU 101 provides the oxygen 151 to the system. A liquid oxygen pump 37 pressurizes the oxygen up to the required pressure level before introduction into the heat exchanger 5, where it undergoes a vaporization or a pseudo-vaporization.

The ASU 101 is fed by air 510 originating from the same compressor 6 (MAC) and by liquid air 235 which is used to compensate for the production of liquid oxygen 150.

The flow 510 is cooled in a heat exchanger independent of the heat exchanger 5 by exchange of heat with the nitrogen gas originating from the air separation unit (not represented). It is possible to cool the cold air in the heat exchanger 5 but this would render the system less flexible.

It is likewise possible to have the air separation unit and this system for recovery of the cold in separate locations. In this case, there would be a compressor system providing air to the ASU and another compressor system providing air to the cold recovery system, and the transportation of the liquid air 235 and of the liquid oxygen 150 can be carried out by tanker or pipeline. The liquid storage tanks 152 and 131 also have to be doubled on each site.

There might also be separate compressor systems providing air to the ASU and to the cold recovery system when the two units are at the same location, if this is regarded as being more convenient and/or more efficient. This is particularly the case when the two units do not operate simultaneously at the same capacity. A single compressor would require a precise measurement procedure and would lose its effectiveness at low capacity. With different compressor systems, it is possible to optimize the measurement procedure on each device.

In order to simplify the process described above, in view of the low flows of 107A and of 107B, it is possible to maintain a single recycled air fraction 107D and low-pressure air to the purification unit 107C.

The valves 231, 116A, 116B and 116C might be replaced with turbines which reduce liquid in pressure, that is to say a pressure-reducing system which produces work, with the aim of decreasing the irreversibility associated with the isenthalpic reduction in pressure. These turbines which reduce liquid in pressure might be installed in parallel and/or in series.

During off-peak periods, when the cost of the electricity is lower than a given value, the air separation unit operates so that the amount of liquid oxygen stored in the storage tank 152 increases. The amount of liquid oxygen vaporized in the heat exchanger 5 is less than the liquid oxygen produced by the air separation unit.

No air is sent to the valve 116C, and the purification unit 7 is regenerated by use of a nitrogen flow originating from the air separation unit 101.

The air flows 510 are sent to the air separation unit via a heat exchanger independent of the heat exchanger 5, and an air flow 235 is sent to the air separation unit from the storage tank 131, and the liquid oxygen 150 is sent to the storage tank 152. However, the amount of liquid air sent to the vessel 131 exceeds the amount of air which is withdrawn therefrom, and the amount of liquid oxygen sent to the vessel 152 exceeds the amount of liquid oxygen which is withdrawn therefrom.

During peak periods, when the cost of the electricity is greater than a given value, the air separation unit does not operate, or operates at low capacity, generally 50% or less of the maximum capacity, even if the total oxygen produced is much greater than 50% of the maximum capacity. No air is sent to the air separation unit by the flows 510 and 235. The liquid oxygen stored in the tank 152 is vaporized to give the oxygen gas flow. The regeneration of the purification unit 7 is carried out by use of the flow 107C.

The liquid air produced by the vaporization of the liquid oxygen is stored in the storage tank 131 during the peak periods, and no gaseous or liquid air is sent to the air separation unit 101.

The process can be modified in order to vaporize the pumped liquid nitrogen, as additional flow or as flow replacing the pumped oxygen flow.

Figure 6:
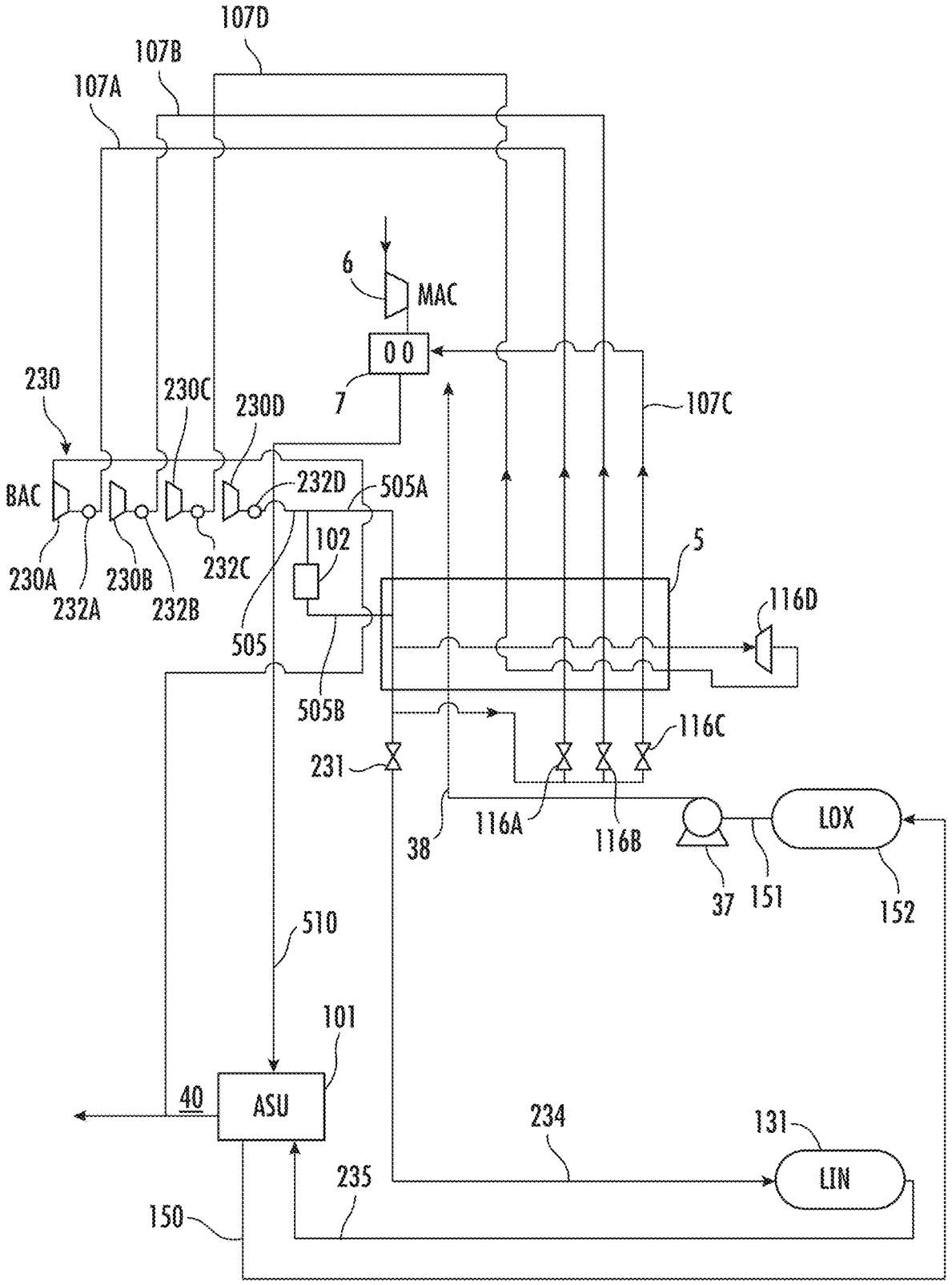
FIG. 6 provides a process flow diagram in accordance with another embodiment of the present invention.

It is likewise possible to use a nitrogen cycle (rather than an air cycle), as is seen in FIG. 6. In this case, the compressor 230 is fed with at least a part of the high-pressure nitrogen gas 40. However, in this case, it is necessary to have available a source of nitrogen, originating from the air separation unit 101 operating at reduced capacity, or from other air separation units, optionally via a nitrogen pipe. This is the reason why it is air which is the preferred fluid for such an application, as it is available independently of any air separation unit.

In this case, all of the feed air is compressed in the main air compressor 6 up to the pressure required for the separation of air in the ASU 101.

The compressed nitrogen is cooled and condensed in the heat exchanger 5.

The compressed nitrogen is subsequently subdivided into at least two portions, three portions being presented in this instance, reduced in pressure to at least two different pressures, and vaporized in the heat exchanger 5.

The vaporized nitrogen originating from the valves 116A and 116B is sent back to intermediate positions of the nitrogen compressor 230, and the vaporized nitrogen originating from the valve 116C can be used to regenerate the purification unit if the air separation unit is not operating.

The liquid nitrogen produced 234 is reduced in pressure in the valve 231 and stored in the storage unit 131 for use.

Thus, the liquid oxygen can be vaporized against the nitrogen in the periods during which the air separation unit is not operating, for example the periods during which the electricity is particularly expensive.

These alternative forms of the invention might be used to recover the cold from a liquid oxygen/nitrogen backup system in the case of a planned unavailability (maintenance) or unplanned unavailability (incident) of the air separation unit or units.

The processes illustrated exhibit double-column systems but it will be easily understood that the invention applies to triple-column systems. It might also be used with process cycles producing oxygen of low purity (usually 95% $O_2$ instead of 99.5% $O_2$), such as "double-vaporizer" process cycles.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. A process for the separation of air by cryogenic distillation in a system of columns comprising a first column and a second column operating at a lower pressure than the first column, the process comprising the steps of:

i) compressing all of a feed air in a first compressor up to a first outlet pressure that is between a pressure of the first column and one bar greater than the pressure of the first column;

ii) sending a first part of the feed air under the first outlet pressure to a second compressor, and then compressing the first part of the air to a second outlet pressure;

iii) cooling and condensing at least a part of the first part of the air under the second outlet pressure in a heat exchanger to form a cooled and condensed air;

iv) sending a second part of air under the first outlet pressure to a system of columns, without more compression, and then separating the second part of air in the system of columns;

v) withdrawing a liquid product from the system of columns, pressurizing the liquid product and vaporizing the liquid product by heat exchange in the heat exchanger; and vi) reducing a pressure of at least a fraction of the cooled and condensed air, from the second outlet pressure to at least a third pressure, at least partially vaporizing said at least a fraction of the cooled and condensed air in the heat exchanger while at the third pressure to form a vaporized air, the third pressure being intermediate between the first outlet pressure and the second outlet pressure, wherein the vaporized air is sent to the second compressor in order to be compressed up to the second outlet pressure.

2. The process as claimed in claim 1, wherein the reduction in pressure is carried out in at least one valve.

3. The process as claimed in claim 1, wherein the reduction in pressure is carried out in at least one turbine and produces work.

4. The process as claimed in claim 1, wherein step vi) further comprises heating of said at least partially vaporized air in the heat exchanger.

5. The process as claimed in claim 1, wherein the temperature of the at least a fraction before reduction in pressure is less than the sum of the temperature of the vaporization of the liquid product and a minimum temperature approach in the heat exchanger.

6. The process as claimed in claim 1, wherein the second compressor is a multistage compressor.

7. The process as claimed in claim 6, wherein said at least a third pressure is at least the inlet pressure of one of the stages of the second compressor.

8. The process as claimed in claim 1, wherein a stage of the second compressor is driven by a device for the reduction in pressure with regard to a fluid of the process.

9. The process as claimed in claim 8, wherein the inlet temperature of the device for the reduction in pressure is less than ambient temperature.

10. The process as claimed in claim 1, wherein at least one stage of the second compressor has a suction temperature which is less than ambient temperature.

11. The process as claimed in claim 10, wherein the suction temperature is greater than the vaporization temperature of the liquid product.

12. The process as claimed in claim 1, wherein the liquid product is a flow enriched in oxygen.

13. The process as claimed in claim 1, wherein the liquid product is a flow enriched in nitrogen.

14. The process as claimed in claim 1, wherein a production flow of the liquid product or products is not greater than 10% of the feed air.

15. The process as claimed in claim 1, wherein the production flow of the liquid product or products is not greater than 5% of the feed air.

16. An apparatus for separating air by cryogenic distillation in a system of columns comprising a first column and a second column operating at a lower pressure than the first column, additionally comprising:

i) a first compressor configured to compress a feed air to a first outlet pressure of at most one bar greater than the pressure of the first column, wherein the first compressor is in fluid communication with the system of columns;

ii) a second compressor in fluid communication with the first compressor, wherein the second compressor is configured to receive a first part of the air under the first outlet pressure from the first compressor to the second compressor, in order to compress the first part of the air to a second outlet pressure to create a boosted air;

iii) a heat exchanger, in which at least a part of the boosted air is cooled and condensed;

iv) a liquid product conduit configured to remove a liquid product from the first column or the second column, a liquid pump configured to pressurize the liquid product, wherein an outlet of the liquid pump is in fluid communication with the heat exchanger, wherein the heat exchanger is configured to vaporize the liquid product to produce a vaporized product; and v) a pressure reducing device selected from the group consisting of a valve, a turbine, and combinations thereof, wherein the pressure reducing device is configured to reduce in pressure a fraction of the air cooled and condensed under the second outlet pressure to form a pressure-reduced air that is at a third pressure, wherein the heat exchanger is in fluid communication with an outlet of the valve or the turbine, wherein the heat exchanger is configured to vaporize at least a part of said pressure-reduced air, wherein the third pressure is between the first outlet pressure and the second outlet pressure;

vi) a second conduit in fluid communication with the heat exchanger and the second compressor, wherein the second conduit is configured to transfer said pressure-reduced air from a warm end of the heat exchanger to an inlet of the second compressor.

17. The apparatus as claimed in claim 16, where the pressure reducing device is a valve.

* * * * *